US010320135B2

(12) United States Patent
Barker

(10) Patent No.: US 10,320,135 B2
(45) Date of Patent: Jun. 11, 2019

(54) MINIATURE INTERCONNECTION DEVICE FOR PYROTECHNICS DISPLAYS

(71) Applicant: Walter D. Barker, State College, PA (US)

(72) Inventor: Walter D. Barker, State College, PA (US)

( * ) Notice: Subject to any disclaimer, the term of this patent is extended or adjusted under 35 U.S.C. 154(b) by 0 days.

(21) Appl. No.: 14/957,867

(22) Filed: Dec. 3, 2015

(65) Prior Publication Data

US 2016/0164203 A1 Jun. 9, 2016

Related U.S. Application Data

(60) Provisional application No. 62/086,903, filed on Dec. 3, 2014.

(51) Int. Cl.

| | |
|---|---|
| ***H01R 12/00*** | (2006.01) |
| ***H01R 31/00*** | (2006.01) |
| ***F42B 4/24*** | (2006.01) |
| *H01R 107/00* | (2006.01) |

(52) U.S. Cl.
CPC ..... *H01R 31/005* (2013.01); *F42B 4/24* (2013.01); *H01R 2107/00* (2013.01)

(58) Field of Classification Search
CPC . H01R 12/716; H01R 12/724; H01R 13/5213
USPC ..... 439/76, 76.1
See application file for complete search history.

(56) References Cited

U.S. PATENT DOCUMENTS 5,227,955 A * 7/1993 Le Bris ..... B60R 16/0238 174/541
6,146,153 A * 11/2000 Koradia ..... H01R 12/716 439/638
6,319,066 B2 * 11/2001 Kuo ..... H01R 13/6215 439/638
6,945,821 B2 * 9/2005 Stoner ..... H01R 31/06 439/638

* cited by examiner

*Primary Examiner* — Phuong K Dinh
(74) *Attorney, Agent, or Firm* — Cohen & Grigsby, P.C.

(57) ABSTRACT

An electrical interconnection device for coupling a firing module to a pyrotechnic electric match may generally comprise a circuit board comprising a first surface and a second surface, an input connector electrically connected to the first surface of the circuit board to couple the device to the firing module and at least one output connector electrically connected to the second surface of the circuit board to couple the device to the pyrotechnic match. The device may have a weight of less than about 200 grams, and a length of less than about 100 mm, a width of less than about 200 mm, and a height of less than about 100 mm. An electrical interconnection system for pyrotechnic displays comprising the electrical interconnection device is also described.

21 Claims, 4 Drawing Sheets

MINIATURE INTERCONNECTION DEVICE FOR PYROTECHNICS DISPLAYS

CROSS REFERENCE TO RELATED APPLICATION

This application claims priority to U.S. provisional application Ser. No. 62/086,903, filed on Dec. 3, 2014, which is hereby incorporated herein by reference in its entirety.

BACKGROUND

Electronic device configurations for pyrotechnic and explosive control systems in pyrotechnic displays, special effects, and blasting industries may generally utilize electrical communication arrangements to provide device-to-device interconnections. As an example, a conventional pyrotechnic display system may involve a substantial amount of interconnectivity accomplished via cabling for interconnection communications. This type of system may involve elaborate techniques for managing, storing, transporting and servicing the cables and large connection devices (e.g., rails). Servicing of systems with substantial numbers of cables and large rails, which may include hundreds of feet of cable and hundreds of connectors, add expense and logistics, which may result in errors when attempting to attach or replace the cables and rails. Accordingly, smaller (i.e., size and weight), more efficient and/or cost-effective electrical interconnection devices for pyrotechnic and explosive control systems and methods of making and using the same are desirable.

SUMMARY

An electrical interconnection device for coupling a firing module to a pyrotechnic electric match may generally comprise a circuit board comprising a first surface and a second surface, an input connector electrically connected to the first surface of the circuit board to couple the device to the firing module, and a first output connector electrically connected to the second surface of the circuit board to couple the device to the pyrotechnic match, wherein the device has a weight of less than about 200 grams, and a length of less than about 100 mm, a width of less than about 200 mm, and a height of less than about 100 mm. The input connector may directly connect to the firing module without cabling.

An electrical interconnection system for pyrotechnic displays may generally comprise a firing module and an electrical interconnection device directly connected to the firing module comprising a circuit board having a first surface and a second surface, an input connector electrically connected to the first surface of the circuit board and electrically connected to the firing module, a first output connector electrically connected to the second surface of the circuit board, a second output connector electrically connected to the second surface of the circuit board, and at least one fastener to secure the device to the firing module, wherein the device has a weight of less than about 114 grams, and a length of less than about 100 mm, a width of less than about 200 mm, and a height of less than about 100 mm. The input connector may be directly connected to the firing module without cabling. The system may have a length of less than about 500 mm, a width of less than about 200 mm, and a height of less than about 100 mm.

An electrical interconnection device for coupling a firing module to a pyrotechnic electric match may generally comprise a circuit board having a first surface and a second surface, a parallel interface plug electrically connected to the first surface of the circuit board, a first electrical terminal block connecter electrically connected to the second surface of the circuit board, and at least one fastener to secure the device to the firing module, wherein the parallel interface plug substantially aligns and engages with a corresponding jack of the firing module to directly connect the device to the firing module, and wherein the device has a weight of less than about 114 grams, and a length of less than about 100 mm, a width of less than about 200 mm, and a height of less than about 100 mm.

DESCRIPTION OF THE DRAWINGS

The various embodiments described herein may be better understood by considering the following description in conjunction with the accompanying drawings.

DESCRIPTION

Figure 1A:
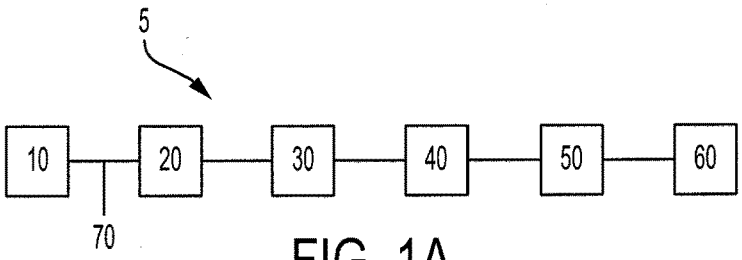
FIG. 1A PRIOR ART
FIG. 1A includes a block diagram of a conventional fireworks firing system.

As generally used herein, the articles "one", "a", "an" and "the" refer to "at least one" or "one or more", unless otherwise indicated.

As generally used herein, the terms "including" and "having" mean "comprising".

As generally used herein, the term "about" refers to an acceptable degree of error for the quantity measured, given the nature or precision of the measurements. Typical exemplary degrees of error may be within 20%, 10%, or 5% of a given value or range of values. Alternatively, the term "about" refers to values within an order of magnitude, potentially within 5-fold or 2-fold of a given value.

All numerical quantities stated herein are approximate unless stated otherwise. Accordingly, the term "about" may be inferred when not expressly stated. The numerical quantities disclosed herein are to be understood as not being strictly limited to the exact numerical values recited. Instead, unless stated otherwise, each numerical value is intended to mean both the recited value and a functionally equivalent range surrounding that value. At the very least, and not as an attempt to limit the application of the doctrine of equivalents to the scope of the claims, each numerical parameter should at least be construed in light of the number of reported significant digits and by applying ordinary rounding techniques. Notwithstanding the approximations of numerical quantities stated herein, the numerical quantities described in specific examples of actual measured values are reported as precisely as possible.

Any numerical range recited in this specification is intended to include all sub-ranges of the same numerical precision subsumed within the recited range. For example, a range of "1.0 to 10.0" is intended to include all sub-ranges between (and including) the recited minimum value of 1.0 and the recited maximum value of 10.0, that is, having a minimum value equal to or greater than 1.0 and a maximum value equal to or less than 10.0. Any maximum numerical limitation recited in this disclosure is intended to include all lower numerical limitations subsumed therein and any minimum numerical limitation recited in this disclosure is intended to include all higher numerical limitations subsumed therein. Accordingly, Applicant reserve the right to amend this specification, including the claims, to expressly recite any sub-range subsumed within the ranges expressly recited herein.

In the following description, certain details are set forth in order to provide a better understanding of various embodiments of electrical interconnection devices and methods for making and using the same. However, one skilled in the art will understand that these embodiments may be practiced without these details and/or in the absence of any details not described herein. In other instances, well-known structures, methods, and/or techniques associated with methods of practicing the various embodiments may not be shown or described in detail to avoid unnecessarily obscuring descriptions of other details of the various embodiments.

This disclosure describes various features, aspects, and advantages of various embodiments of electrical interconnection devices. It is understood, however, that this disclosure embraces numerous alternative embodiments that may be accomplished by combining any of the various features, aspects, and advantages of the various embodiments described herein in any combination or sub-combination that one of ordinary skill in the art may find useful. Such combinations or sub-combinations are intended to be included within the scope of this specification. As such, the claims may be amended to recite any features or aspects expressly or inherently described in, or otherwise expressly or inherently supported by, the present disclosure. Further, Applicants reserve the right to amend the claims to affirmatively disclaim any features or aspects that may be present in the prior art. The various embodiments disclosed and described in this disclosure may comprise, consist of, or consist essentially of the features and aspects as variously described herein.

According to certain embodiments, smaller (i.e., size and weight), more efficient and/or cost-effective electrical interconnection devices for pyrotechnic and explosive control systems and methods of making and using the same are described Referring to FIG. 1, a conventional fireworks firing system 5 may comprise a computer 10, a control panel 20, a firing module 30, a conventional connection device 40 (e.g., a rail), an electric firing match 50, and a projectile 60 in electrical communication via cables 70. Alternately the controlling parameters of the system may be accomplished via a wireless link through radio frequencies, for example. The system may include software configured to create manually fired firework displays and choreographed firework displays. The computer 10, which operates the software, may be in electrical communication with the control panel 20. The control panel 20 may be in wired or wireless electrical communication with the firing module 30. The firing module 30 may comprise a microprocessor controlled and capacitive discharge module. The firing module 30 may be in electrical communication with the connection rail 40. The connection device 40 may have at least one individual connection terminals (i.e., cues) configured to electrically connect to an electric firing match 50 and/or projectile 60 via cables 70. A digital fireworks firing system and choreography system is commercially available from Pyrotechnics Management Inc., State College, Pa.

Figure 1B:
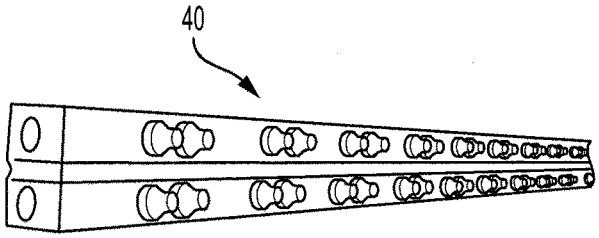
FIG. 1B PRIOR ART
FIG. 1B includes a block diagram of a conventional connection rail.
Figure 2:
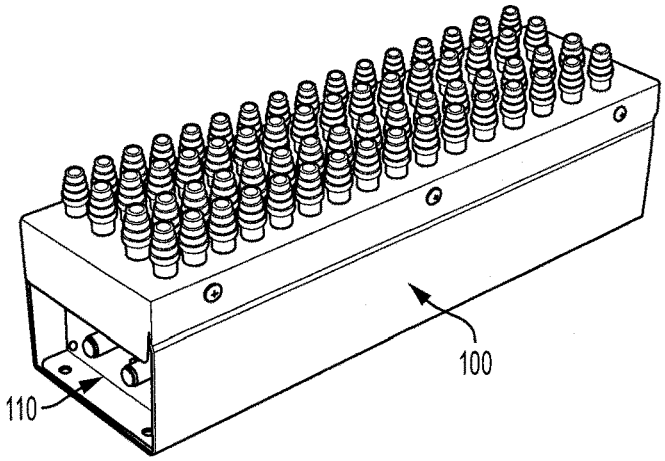
FIG. 2 PRIOR ART
FIG. 2 includes an illustration of a conventional compact connection device.
Figure 3:
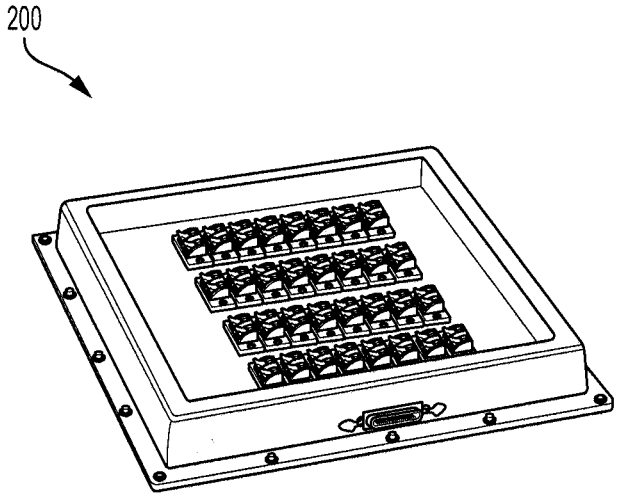
FIG. 3 PRIOR ART
FIG. 3 includes an illustration of a conventional flat connection device.

Three types of conventional connection devices are shown in FIGS. 1-3. FIG. 1B illustrates a conventional large connection rail 40, FIG. 2 illustrates a conventional compact connection device 100, and FIG. 3 illustrates a conventional flat connection device 200. The large connection rail 40 shown in FIG. 1B has a length of 245 cm and a weight of 6.8 KG, and may be generally referred to as an "eight foot" rail 40. The connection device 100 shown in FIG. 2 has a length of 40.7 cm, a width of 11.8 cm, and weight of 2.2 KG. As shown in FIG. 2, a compact connection device 100 may house the firing module 110. The connection device 200 shown in FIG. 3 is 45 cm by 48 cm. In general, the dimensions of all of these conventional connection devices may be significantly greater than the corresponding dimensions of the firing module such that the compact connectional device, as shown in FIG. 2, for example, may include an internal space for electrically connecting and housing the firing module.

In general, the size and weight and performance may be at a premium in the deployment of complex control systems. Therefore. in contrast, according to various embodiments, an electrical system generally comprising the electrical interconnection device as generally described herein electrically connected to a firing module provides a significantly more compact, lightweight, robust system relative to existing connection devices and firing modules. The electrical system may be more efficient and/or cost-effective than existing connection rails and firing modules. The electrical system may be useful for aerial displays, stage shows, close proximity material, groups of candles, gerbs, or other material wherein space and size are at a premium.

An electrical interconnection device for coupling a firing module to a pyrotechnic electric match may generally comprise a circuit board comprising a first surface and a second surface, an input connector electrically connected to the first surface of the circuit board to couple the device to the firing module, and a first output connector electrically connected to the second surface of the circuit board to couple the device to the pyrotechnic match, wherein the device has a weight of less than about 200 grams, and a length of less than about 100 mm, a width of less than about 200 mm, and a height of less than about 100 mm. The device may comprise at least one fastener, e.g., a screw, to secure the device to the firing module.

The input connector may directly connect to the firing module without cabling therebetween. The input connector may substantially align with and engage a corresponding jack of the firing module to directly connect the device to the firing module. The input connector may comprise one of a male interface connector (i.e., a plug) and a female interface connector (i.e., jack). The input connector plug may comprise a parallel interface connector, or other types of connectors.

The device may comprise a second output connector electrically connected to the second surface of the circuit board. The first output connector and second output connector may independently comprise an electrical terminal block connecter. The electrical terminal block connector may comprise a printed circuit board plug-in connector jack to couple the device to the pyrotechnic match.

The input connector may be disposed in a center portion of the first surface and the first output connector may be disposed in a first outer portion of the second surface, and optionally, a second output connector may be disposed in a second outer portion of the second surface.

An electrical interconnection system for pyrotechnic displays may comprise a firing module and an electrical interconnection device directly connected to the firing module or alternately integrated together into a composite package. The electrical interconnection system for pyrotechnic displays may generally comprise a firing module and an electrical interconnection device directly connected to the firing module comprising a circuit board having a first surface and a second surface, an input connector electrically connected to the first surface of the circuit board and electrically connected to the firing module, a first output connector electrically connected to the second surface of the circuit board, a second output connector electrically connected to the second surface of the circuit board, and at least one fastener to secure the device to the firing module, wherein the device has a weight of less than about 114 grams, and a length of less than about 100 mm, a width of less than about 200 mm, and a height of less than about 100 mm. The input connector may be direct connected to the firing module without cabling. The input connector may comprise a plug that substantially aligns with a corresponding jack of the firing module to directly connect the input connector to the firing module. The plug may comprise a parallel interface plug and the jack comprises printed circuit board plug-in connector. The system may have a length of less than about 500 mm, a width of less than about 200 mm, and a height of less than about 100 mm.

An electrical interconnection device for coupling a firing module to a pyrotechnic electric match may generally comprise a circuit board having a first surface and a second surface, a parallel interface plug electrically connected to the first surface of the circuit board, a first electrical terminal block connecter electrically connected to the second surface of the circuit board, and at least one fastener to secure the device to the firing module, wherein the parallel interface plug substantially aligns and engages with a corresponding jack of the firing module to directly connect the device to the firing module, and wherein the device has a weight of less than about 114 grams, and a length of less than about 100 mm, a width of less than about 200 mm, and a height of less than about 100 mm. The device may comprise a second electrical terminal block connecter electrically connected to the second surface of the circuit board. Each of the first electrical terminal block connector and second electrical terminal block connector may independently comprise a printed circuit board plug-in connector jack to couple the device to the pyrotechnic match. The input connector may be disposed in the center portion of the first surface, the first output connector may be disposed in the first outer portion of the second surface, and the second output connector may be disposed in the second outer portion of the second surface.

Figure 4:
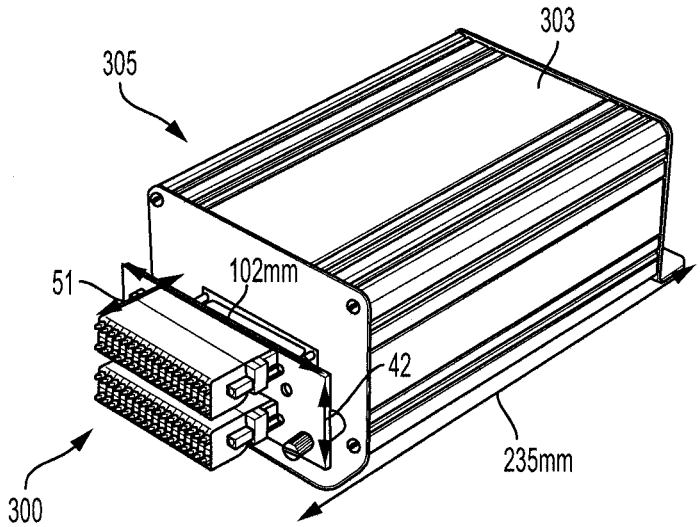
FIG. 4 includes an illustration of an electrical interconnection system according to various embodiments.

FIG. 4 illustrates an electrical interconnection system 305. As shown in FIG. 4, in various embodiments an electrical interconnection system 305 may comprise an electrical interconnection device 300 directly connected to a firing module 303 without cables. The electrical interconnection system 305 may lack cabling to electrically couple the electrical interconnection device 300 to the firing module 303. The electrical interconnection device 300 may have dimensions (i.e., a height, length, and/or width and/or weight) much less than the corresponding dimensions and weight of the firing module 303 or conventional connection rails. The electrical interconnection device 300 may have a weight up to 250 grams, such as 50 grams to 200 grams, and 100 grams to 150 grams, and 114 grams. The electrical interconnection device 300 may have a length from 25 mm to 100 mm, a width from 50 mm to 200 mm, and a height from 20 mm to 80 mm. The overall length of the firing module 303 connected directly to the interconnection device 300 without cables may have a total length from 100 mm to 500 mm. As shown in FIG. 4, the electrical interconnection device 300 may have a weight of 114 grams, a length of 51 mm, a width of 102 mm, and a height of 42 mm, wherein the overall length of the firing module 303 with the interconnection device 300 may have a total length of 235 mm. In various embodiments, the firing module 303 may comprise a wireless firing module configured to interface with the control panel.

Figure 5:
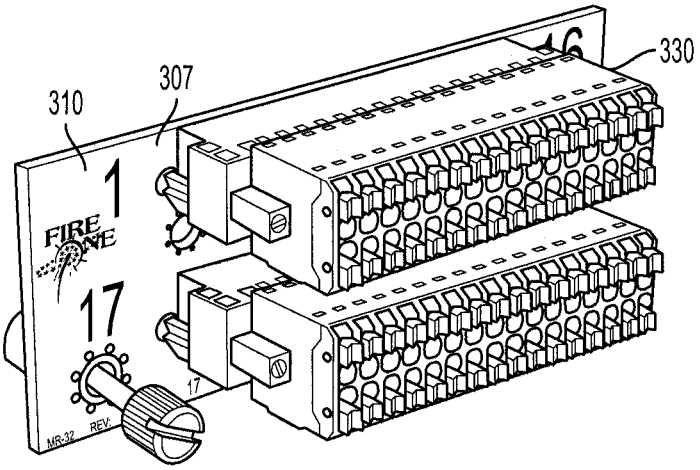
FIGS. 5-7 include illustrations of an electrical interconnection device according to various embodiments.
Figure 6:
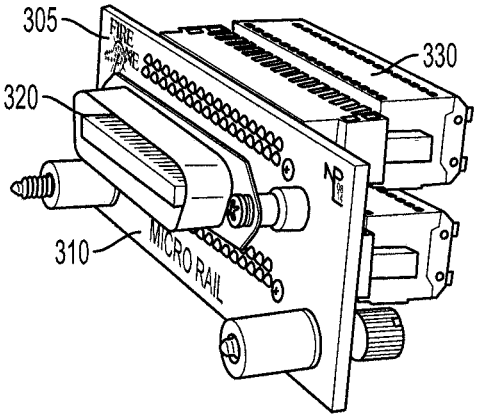
Figure 7:
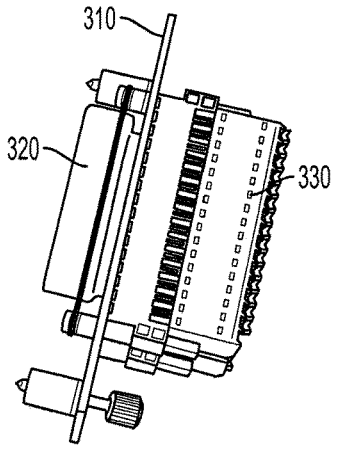
Figure 8:
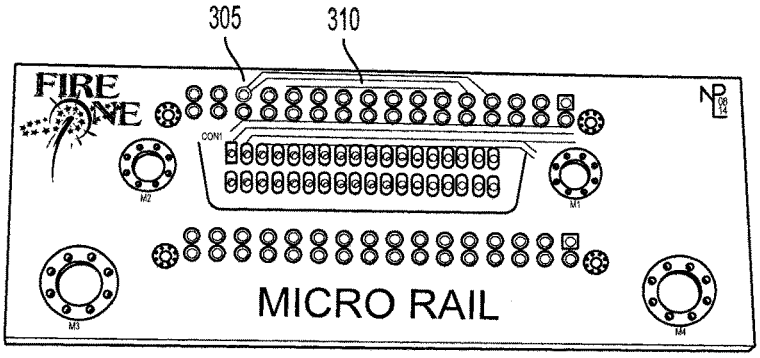
FIG. 8 includes an illustration of a circuit board for the electrical interconnection devices according to various embodiments.

Referring to FIGS. 5-7, according to various embodiments, an electrical interconnection device 300 may comprise a circuit board 310 having a first surface 305 and a second surface 307, an input connector 320 electrically connected to the first surface 305 of the circuit board 310, and an output connector 330 electrically connected to the second surface 307 of the circuit board 310. Referring to FIG. 8, the circuit board 310 may be configured to electrically connect the input connector 320 and output connector 330 such that the input connector 305 is in electrical communication with the output connector 320.

The input connector 320 may comprise any type of connecter to couple to a mating connector of a firing module. The input connector 320 may comprise a male or female parallel interface or Centronics-type connector or various other connectors. The input connector 320 may comprise a male interface (i.e., plug) when the firing module comprises a female interface (i.e., jack). The input connector 320 may comprise a male parallel interface when the firing module comprises a female parallel interface. The input connector 320 may electrically connect to a firing module.

The output connector 330 may comprise any type of connecter to couple to a mating connector of an electric firing match and/or projectile. The output connector 330 may comprise an electrical terminal block connecter. The electrical terminal block connector may generally function as a connection rail to electrically connect the firing module to the electric firing match. The electrical terminal block connector may comprise a printed circuit board plug-in connector, female plug. The electrical terminal block may comprise at least one cue, such as, for example, 1 cue to 32 or more cues, e.g., 128 cues. The electrical terminal block may comprise 8 cues, 16 cues, 32 cues, 64 cues, or 128 cues or more cues. The electrical output connector may electrically connect to the electric firing match and/or projectile. The electrical interconnection device may electrically connect a firing module to an electric firing match and/or projectile.

Although the electrical interconnection device has been described for use in connection with a parallel interface input connection and a PCB female plug-in output connector, it is apparent that various other types of input and/or output connectors may be used as well. For example, the input and output connection may comprise rectangular, circular, edge, coaxial, mezzanine, D-Sub, magnetic, socket, surface mount, board edge and many other types.

Figure 9:
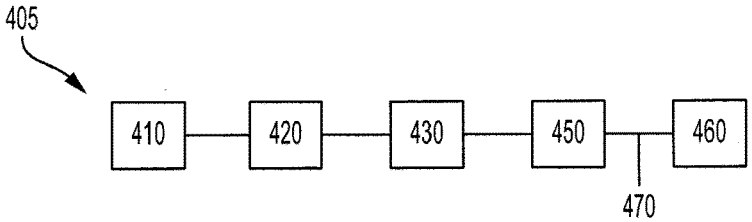
FIG. 9 includes a block diagram of a fireworks firing system according to various embodiments.

Referring to FIG. 9, according to various embodiments, a firework firing system 405 may comprise a computer 410, a control panel 420, an electrical system 430, an electric firing match 450, and a projectile 460. The electrical system 430 may comprise an electrical interconnection device 300, as shown in FIG. 4, directly connected to the firing module 303 (without cables). The computer 410, which operates the software, may be in electrical communication with the control panel 420. The control panel 420 may be in electrical communication with the electrical system 430. The electrical system 430 may have at least one individual connection terminals (i.e., cues) configured to electrically connect to an electric firing match 450 and/or projectile 460 via cables 470.

In various embodiments, an electrical interconnection device may be characterized by a miniature size, weight and nature (relative to conventional devices and systems) capable of adjoining directly to and adhering to a small portable control device ("Module"), such as a firing module. This device may provide the electric signal being communicated through the electrical interconnection device. The electrical interconnection device may comprise a unique miniature interconnection device that provides an extremely small, light weight, robust, quick connection system for wiring between electric and electronic controlled pyrotechnic and other commercial and industrial systems.

The electrical interconnection device may comprise an input connector (e.g., a Centronics connector) mounted on one side of a circuit board and an output connector (e.g., a series of push button connection terminals) mounted on another side of the circuit board, and the framework necessary for one to electrically communicate directly with the other. The electrical interconnection device may be configured to communicate electric signals, input through the input connector (e.g., a Centronics connection) to another device, that signal being output through the output connector (e.g., a series of push button connection terminals). These electric signals consists of as many as thirty-two (32) or more independent electrical pulses ("Cues"), each Cue supplying nominal voltage and current sufficient to satisfy a circuit ("Circuit") requiring a minimum voltage and current capable of igniting standard pyrotechnic electric matches. The primary purpose of this Circuit is to provide sufficient power transfer to ignite electric firing matches compatible with electrical and electronic firing panels, which are used to execute pyrotechnic displays, and for other commercial and industrial purposes.

According to various embodiments, a method for electrically connecting a firing module to an electric firing match may comprise providing an electrical interconnection device as generally described above, connecting the input connector to the firing module, and connecting the output connector to the electric firing match. In contrast to conventional connection rails and devices, the electric firing matches may be electrically connected to the electrical interconnection device prior to electrically connecting the electrical interconnection device to the firing module. The electrical interconnection device may be configured to be rapidly, mechanically disconnect from a module, such as a control module or firing module. The electrical interconnection device may be configured to be held in the palm of a user's hand to facilitate interconnection wiring to electric matches, thereby centralizing and expediting the connection process.

While particular embodiments of electrical interconnection devices and systems comprising the same have been illustrated and described, it would be obvious to those skilled in the art that various other changes and modifications can be made without departing from the spirit and scope of the invention. Those skilled in the art will recognize, or be able to ascertain using no more than routine experimentation, numerous equivalents to the specific devices, systems, and methods described herein, including alternatives, variants, additions, deletions, modifications and substitutions. This application including the appended claims is therefore intended to cover all such changes and modifications that are within the scope of this application.

What is claimed is:

1. An electrical interconnection device for coupling a firing module to at least one pyrotechnical electrical match, the device consisting of:

a circuit board comprising a first surface having a length, a width, and a height, and a second surface having a length, a width, and a height;

a single male input connector electrically connected parallel to the first surface of the circuit board to couple the device to the firing module;

a first female output connector electrically connected parallel to the second surface of the circuit board to couple the device to the at least one pyrotechnic electric match;

a second female output connector electrically connected parallel to the second surface of the circuit board to couple the device to the at least one pyrotechnic electric match;

at least one fastener to secure the device to the firing module;

wherein the device has a weight of less than about 150 grams, a length of less than about 100 mm, a width of less than about 200 mm, and a height of less than about 100 mm, wherein each of the first surface and the second surface comprise a center portion between a first outer portion and a second outer portion, wherein the input connector is disposed in the center portion of the first surface, the first female output connector is disposed in the first outer portion of the second surface, and the second female output connector is disposed in the second outer portion of the second surface, wherein the length, width, and height of the first surface is the same as the length, width, and height of the second surface, wherein the width of the first surface is greater than the height of the first surface, wherein the height of the first surface is less than a height of the firing module, and wherein the single male input connector, the first female output connector, and the second female output connector are each coplanar with the firing module when the device is connected to the firing module.

2. The device of claim 1, wherein the single male input connector directly connects to the firing module.

3. The device of claim 1, wherein the single male input connector substantially aligns with and engages a corresponding jack of the firing module to directly connect the device to the firing module.

4. The device of claim 3, wherein the input connector is an interface connector plug.

5. The device of claim 4, wherein the single male input connector plug is a parallel interface connector.

6. The device of claim 1, wherein the first female output connector is an electrical terminal block connector.

7. The device of claim 6, wherein the electrical terminal block connector comprises a printed circuit board plug in connector jack to couple the device to the pyrotechnic match.

8. An electrical interconnection system for pyrotechnic displays, the system comprising:

a firing module; and the electrical interconnection device of claim 1 directly connected by the single male input connector to the firing module.

9. The system of claim 8, wherein the single male input connector comprises a plug that substantially aligns with a corresponding jack of the firing module to directly connect the single male input connector to the firing module.

10. The system of claim 9, wherein the plug comprises a parallel interface plug and the jack comprises a printed circuit board plug-in connector.

11. The system of claim 8, where in the system has a length of less than about 50 mm, a width of less than about 200 mm, and a height of less than about 100 mm.

12. The system of claim 8 comprising:

at least one pyrotechnic electric match electrically coupled to one of the first female output connector and the second female output connect; and a pyrotechnic device electrically coupled to the at least one electric match.

13. An electrical interconnection device for coupling a firing module to a pyrotechnic electric match, the device consisting of:

a circuit board having a first surface having a length, a width, and a height, and a second surface having a length, a width, and a height;

a single male parallel interface plug electrically connected to the first surface of the circuit board;

a first female electrical terminal block connecter electrically connected parallel to the second surface of the circuit board;

a second female electrical terminal block connecter electrically connected parallel to the second surface of the circuit board; and at least one fastener to secure the device to the firing module, wherein the single male parallel interface plug substantially aligns and engages with a corresponding jack of the firing module to directly connect the device to the firing module, wherein the length, width, and height of the first surface is the same as the length, width, and height of the second surface, and wherein the device has a weight of less than about 125 grams, and a length of less than about 100 mm, a width of less than about 200 mm, and a height of less than about 100 mm.

14. The device of claim 13, wherein each of the first female electrical terminal block connector and the second female electrical terminal block connector comprise a printed circuit board plug-in connector jack to couple the device to the pyrotechnic electric match.

15. The device of claim 13 wherein each of the first surface and the second surface comprise a center portion between a first outer portion and a second outer portion, and wherein the single male parallel interface plug is disposed in the center portion of the first surface, the first female electrical terminal block connecter is disposed in the first outer portion of the second surface, and the second female electrical terminal block connecter is disposed in the second outer portion of the second surface.

16. The device of claim 13, wherein the input connector single male parallel interface plug, the first female output connector, and the second female output connector are each coplanar with the firing module when the parallel interface plug is engaged with the corresponding jack of the firing module.

17. The device of claim 13, wherein the firing module has a length, a width, and a height, and wherein the height of the firing module is greater than the height of the first surface.

18. The device of claim 13, wherein the width of the first surface is greater than the height of the first surface.

19. An electrical interconnection device for coupling a firing module to a pyrotechnic electric match, the device comprising:

a circuit board comprising a first surface having a length, a width, and a height, and a second surface having a length, a width, and a height;

an input connector electrically connected parallel to the first surface of the circuit board to couple the device to the firing module; and a first output connector electrically connected parallel to the second surface of the circuit board to couple the device to the pyrotechnic match;

wherein the device has a weight of less than about 150 grams, and a length of less than about 100 mm, a width of less than about 200 mm, and a height of less than about 100 mm; and wherein the length, width, and height of the first surface is the same as the length, width, and height of the second surface, wherein the width of the first surface is greater than the height of the first surface, wherein the input connector and the first output connector are each coplanar with the firing module when the device is connected to the firing module;

wherein the input connector consists of a single male parallel interface plug.

20. The device of claim 19, wherein the firing module has a length, a width, and a height, and wherein the height of the firing module is greater than the height of the first surface.

21. The device of claim 19 comprising a second female output connector electrically connected to the second surface of the circuit board, and wherein the second female output connector is coplanar with the firing module when the device is connected to the firing module.

* * * * *